US010604950B2

(12) United States Patent
Mikhaylenko

(10) Patent No.: US 10,604,950 B2
(45) Date of Patent: Mar. 31, 2020

(54) SHOWER FLOOR MUD FORMING DEVICE AND METHODOLOGY

(71) Applicant: Vadim Mikhaylenko, Jacksonville, FL (US)

(72) Inventor: Vadim Mikhaylenko, Jacksonville, FL (US)

( * ) Notice: Subject to any disclaimer, the term of this patent is extended or adjusted under 35 U.S.C. 154(b) by 144 days.

(21) Appl. No.: 16/025,623

(22) Filed: Jul. 2, 2018

(65) Prior Publication Data

US 2019/0003190 A1 Jan. 3, 2019

Related U.S. Application Data

(60) Provisional application No. 62/527,669, filed on Jun. 30, 2017.

(51) Int. Cl.

| | |
|---|---|
| ***E04F 21/24*** | (2006.01) |
| ***E04G 21/10*** | (2006.01) |
| ***A47K 3/40*** | (2006.01) |
| *E04F 21/04* | (2006.01) |
| *E04G 21/18* | (2006.01) |

(52) U.S. Cl.

CPC ..... *E04F 21/244* (2013.01); *E04G 21/10* (2013.01); *A47K 3/40* (2013.01); *E04F 21/04* (2013.01); *E04G 21/185* (2013.01)

(58) Field of Classification Search

USPC ..... 52/318, 364, 367, 371; 4/613; 404/97, 404/118

See application file for complete search history.

(56) References Cited

U.S. PATENT DOCUMENTS 2,529,354 A * 11/1950 Schroeder ..... A21B 3/13 220/506
5,281,050 A * 1/1994 Howard ..... E01C 19/402 404/120
5,371,980 A * 12/1994 Dix ..... A47K 3/40 4/613
6,088,984 A * 7/2000 Kirby ..... E04F 15/00 404/2
6,155,015 A * 12/2000 Kirby ..... A47K 3/40 264/271.1
6,848,229 B2 2/2005 Rossi
(Continued)

FOREIGN PATENT DOCUMENTS

GB 2231075 A * 11/1990 ..... E04F 21/244

*Primary Examiner* — Robert Canfield
(74) *Attorney, Agent, or Firm* — Lawrence J. Gibney

(57) ABSTRACT

A shower floor mud forming device includes two rings, at least one section of the big ring, implanted into shower floor mud in desired location and orientation. Device installed without or with the slope guide which ensures correct location and orientation of the rings and section of the big ring. Those elements of the device are functioning as a support for screed tool, which removes/shaves off excess of the floor mud on top of the elements of the device. Correct location and orientation of those elements ensure desired smooth surface and desired slope of the shower floor mud, which ensures correct surface of the finished shower floor. Elements of the device can be reusable or disposable. Slope guide can be used with or without leveling adjusters. Slope guide can be used without or with the pole, which can be used for alternative way to verify level of the top surface of the slope guide.

40 Claims, 9 Drawing Sheets

(56) References Cited

U.S. PATENT DOCUMENTS

| | | | | |
|---|---|---|---|---|
| 7,296,948 | B2 | 11/2007 | Mikhaylenko | |
| 7,470,083 | B2 | 12/2008 | Black | |
| 9,545,178 | B2 | 1/2017 | Schaffer et al. | |
| 2003/0037497 | A1* | 2/2003 | Kirby | A47K 3/40 52/302.1 |
| 2003/0196407 | A1* | 10/2003 | Rossi | E04F 21/00 52/749.1 |
| 2006/0222459 | A1* | 10/2006 | Mikhaylenko | E04G 21/10 404/118 |
| 2008/0184480 | A1* | 8/2008 | Adleman | A47K 3/40 4/613 |
| 2010/0202831 | A1 | 8/2010 | Saranga | |

* cited by examiner

SHOWER FLOOR MUD FORMING DEVICE AND METHODOLOGY

RELATED APPLICATIONS

The present nonprovisional patent application claims the benefit of the filing date under 35 U.S.C. § 119(e) of Provisional Patent Application Ser. No. 62/527,669 filed on Jun. 30, 2017.

FIELD OF THE INVENTION

This invention relates to installing a drain in a shower and the correct way to achieve that result. In a shower, the drain is normally in the approximate center of the space that is enclosed by the shower. In order to avoid the pooling of water in the shower space the floor surface should be slightly sloped so that the water in the shower will naturally drain towards the location of the shower drain. If the shower floor surface does not have this slope, the water will pool in the shower space and this pooling may become a hazard for persons using the shower as well as providing an incubator for mold and mildew in the shower.

In the installation of a shower drain, the drain is usually set first in the surface and then floor mud is poured around it. Floor mud is the base for ceramic tile or another material installed on top of floor mud later. A screed, which is a common tool in the installation of shower drains is used to form floor mud surface around the drain area to insure the appropriate slope that is required. In addition to the use of the screed to level the floor mud and provide the slope, the screed also insures that the surface of the shower floor mud is flat. In order to create correct, uniform shower floor mud surface, it's required that screed slides on top of rigid structure with desired shape, which determines shape of the shower floor mud surface after excess of the floor mud shaved off by the screed. This device represents one of the embodiments of such supportive structure.

PRIOR ART

There are prior art references to how to form a shower floor mud and a sample of this can be found in Rossi U.S. Pat. No. 6,848,229 B2.

Beside other differences, this device is substantially different from the operation of this particular device that has been filed in this case because referenced in prior art device is not producing uniform slope around shower floor area if the drain is placed other than in the center of a shower floor and if a shape of a shower floor is square. FIG. 4 of the prior art application demonstrates this point.

It is important to a uniform slope so that the water drains properly and perhaps just as importantly so as to reduce injury by pooling the water and excessive slope and to follow construction code requirements.

BRIEF DESCRIPTION OF THE INVENTION

One of the important parts of the shower floor building process is in making a specially designed shape of the shower floor. There are certain functional and cosmetic considerations in the installation of a shower floor and shower drain. Often the functional considerations will also address the cosmetic concerns.

With regard to cosmetic concerns the shower floor surface should appear to be without any obvious raised or lowered surfaces. This obviously requires a smooth surface and the experienced craftsman will insure that the surface is smooth. However, the surface should also provide a slight slope so that the water in the shower goes in the direction of the drain. There are building codes that dictate the amount of the slope that is required. Compliance with the building codes are mandatory.

Typically, the foundation of a house is concrete and the area around a shower is designated. In a shower floor, the drain is usually placed in the general middle of this surface and slightly elevated from the concrete surface. Shower floor mud is then placed over the shower floor around the drain. It is shower floor mud that forms the shape of the floor of the actual shower. Any shower floor surface such as ceramic tile is placed on top of the shower floor mud when the shower floor is mainly complete.

The skilled craftsman uses a tool, which is called a screed, and other construction tools like torpedo level, 2 or 4 feet levels, flat trowels and other construction hand tools to build the shower floor mud and provide a slope to the shower drain. The forming of the shower floor mud surface can be tedious and time consuming even for the most experienced craftsman.

Unfortunately, many shower floors do not meet the requirements of the construction codes and either produce pooling of the water in the shower area or an inappropriate cosmetic appearance, both of which are unacceptable. When a shower floor does not meet the code requirements, several different problems may arise: the shower floor holds water and mold against the wall surface. Over the long term, it will destroy the wall and any structure around the wall. Additionally, and perhaps most importantly is that the floor surface has a slope that is not compliant with the code is not safe for the consumer because the increased risk of slip and fall not to mention the aesthetic quality it is usually unacceptable.

The tool that is described in this application is designed to solve these issues with a simple to use tool and process to create the desired slope to a shower drain. When this tool is used properly, the use of the tool will save time and money while producing a superior product that is both compliant with the appropriate building codes, functional and aesthetically pleasing to the consumer.

There are five separate elements to this particular patent application: screed rings, segment(s) of the big screed ring, screed edges, slope guide and screed tool.

NUMBER REFERENCES

1—Mud Forming Device (First embodiment)
2—Shower drain
5—First Screed Ring
10—Second Screed Ring
11—Segment of the Second Screed Ring
20—Screed Edge
30—Slope Guide
35—op surface of the slope guide
40—First ring groove
41—Bottom of first ring groove
45—Second ring groove
46—Bottom of second ring groove
55—Holding Screw
60—Plurality of Leveling adjusters
65—Recessed bottom surface of slope guide
70—Handle
75—Shower Floor Mud
80—Screed Tool

LETTER REFERENCES

A—The difference between depths of first ring groove and second ring groove
B—The distance between the small screed ring and the large screed ring or large screed ring segment
C—The distance between the small screed ring and the center of the drain
D—The distance between the large screed ring or large screed ring segment and the center of the drain
E—Distance between the top surface of the slope guide and the screed edge of the large screed ring
F—Distance between the top surface of the slope guide and the screed edge of the small screed ring
H—Distance between the top surface of the drain and the top surface of the mud floor
Z—Geometric center of the drain, small screed ring, and large screed ring or screed ring segment

DETAILED DESCRIPTION OF THE EMBODIMENTS

In this first embodiment, this device is comprised of: a first screed ring 5, a second screed ring 10, and a slope guide 30. A screed ring is a rigid ring-shaped element with a predetermined shape which has a top edge and is commonly referred to as a screed edge 20. During the use of this device, a first screed ring 5 and a second screed ring 10, each having different desired radiuses and being placed on different horizontal planes, are located and placed on the shower floor mud. The first screed ring 5 has a smaller diameter than the second screed ring 10. The first screed ring 5 also has a lower altitude, which is below the top of the drain, relative to the second screed ring 10. Each screed ring has a predetermined height and thickness.

Figure 2:
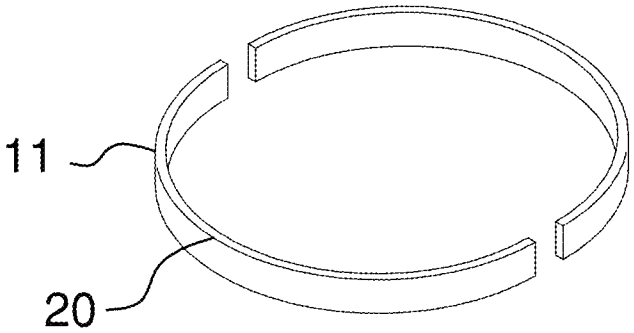
FIG. 2 is an isometric view of segments of the large screed ring.
Figure 1:
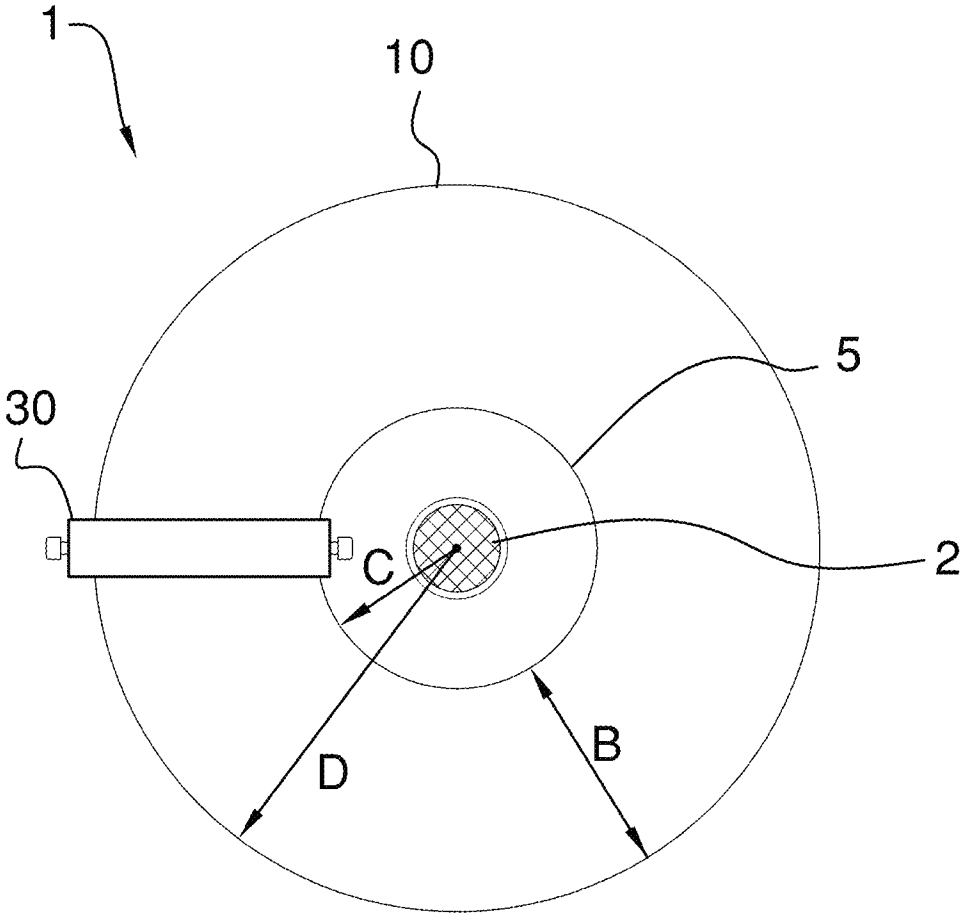
FIG. 1 is a top view of the small screed ring and large screed ring and slope guide.
Figure 4:
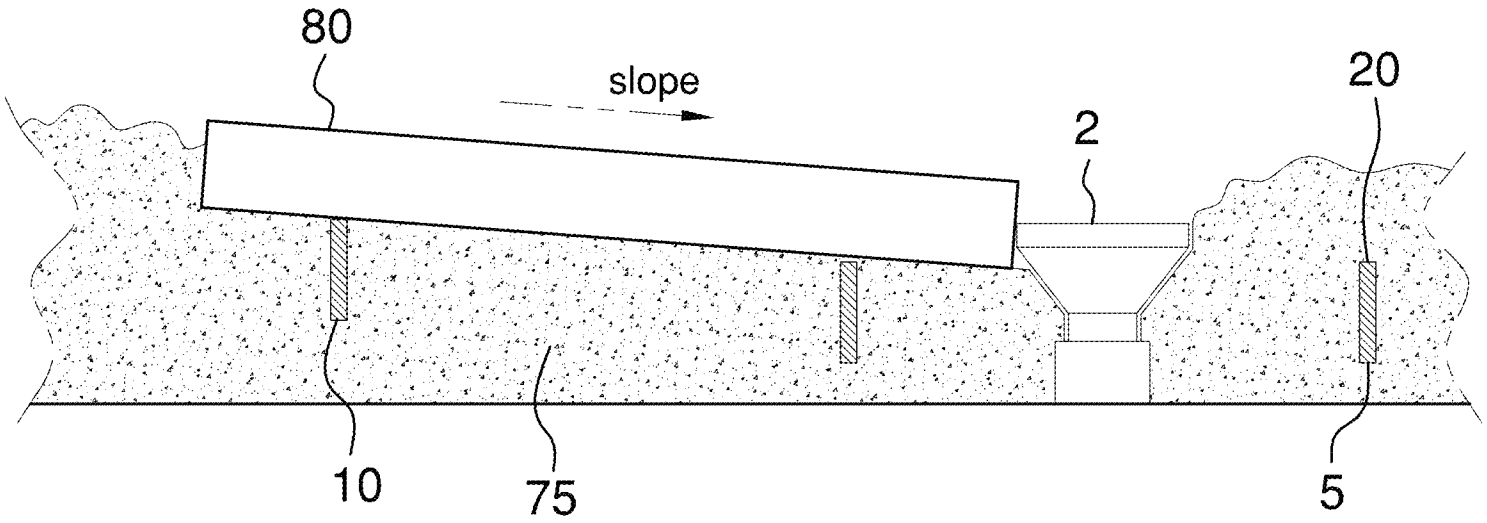
FIG. 4 is a cross-sectional view of the screed tool pressed against the top edge of the large screed and the top edge of the small screed ring.

The geometric centers of the screed rings are located on the same vertical axis, FIG. 1, which passes through the center of the shower drain. In other words, the drain 1, the first screed ring 5, the second screed ring 10 are placed concentrically. Once the drain 2 is attached to the shower drain pipe extending from the foundation or floor of a building, mud is placed on the foundation or floor of the shower. The first screed ring 5 and second screed ring 10 are implanted into the shower floor mud as depicted in FIG. 4. When the screed rings are installed, the geometric centers of the screed rings are located on the same vertical axis "Z" point, which passes through the center of the drain. The screed edges 20 of first screed ring 5 and second screed ring 10 must be located on two different horizontal planes with desired distances between them. The first and second screed rings are implanted temporarily or permanently into the shower floor mud 75.

Figure 6:
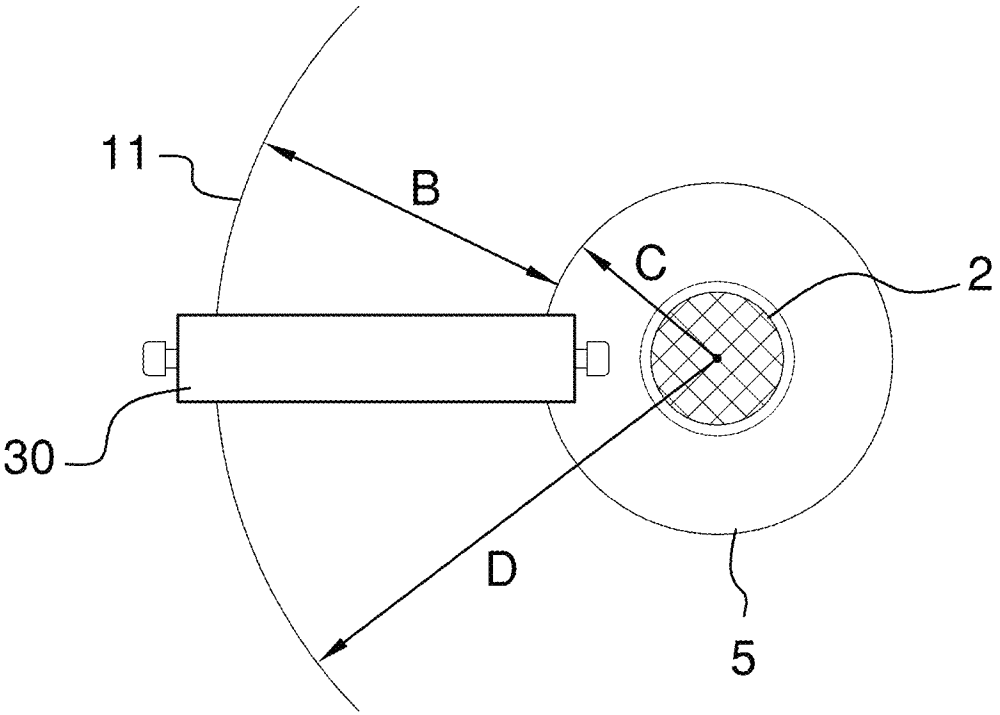
FIG. 6 is a top view of the small screed ring, segment of the large screed ring, and slope guide.

It is anticipated that this device may be alternatively comprised of a first screed ring 5 and at least one segment 11 of a second screed ring. FIG. 6 depicts the device being used with only one segment 11 of the second screed ring. If more than one segment 11 is provided, the segments 11 of the second screed rings can be interconnected to form a complete circular screed ring. It is anticipated that one first screed ring 5 and at least one segment of the second screed ring 11 are required, which is shown in FIG. 6.

Both first screed ring 5 and segment of the second screed ring 11 has a screed edge 20. The screed edge 20 is the top edge of a screed ring or segment of a screed ring and the screed edge 20 supports a screed 80. The screed rings, segment of a screed ring, or segments of a screed ring are also referred to, herein, as screed elements. The screed 80 is a rigid structurally sound element which has a straight edge, which is used for removing excess of the floor mud 75 which is above the screed elements, which are comprised of a first screed ring 5, and at least one segment of the second screed ring 10. The orientation and location of the screed edges 20 determines the desired orientation of the screed tool 80 such as depicted in FIG. 4 and determines the desired slope/shape of the shower floor mud 75. At least two screed edges 20, with each screed edge 20 provided on a screed ring and segment of a screed ring and the radius different desired radiuses and located on different desired horizontal planes are required.

Figure 3:
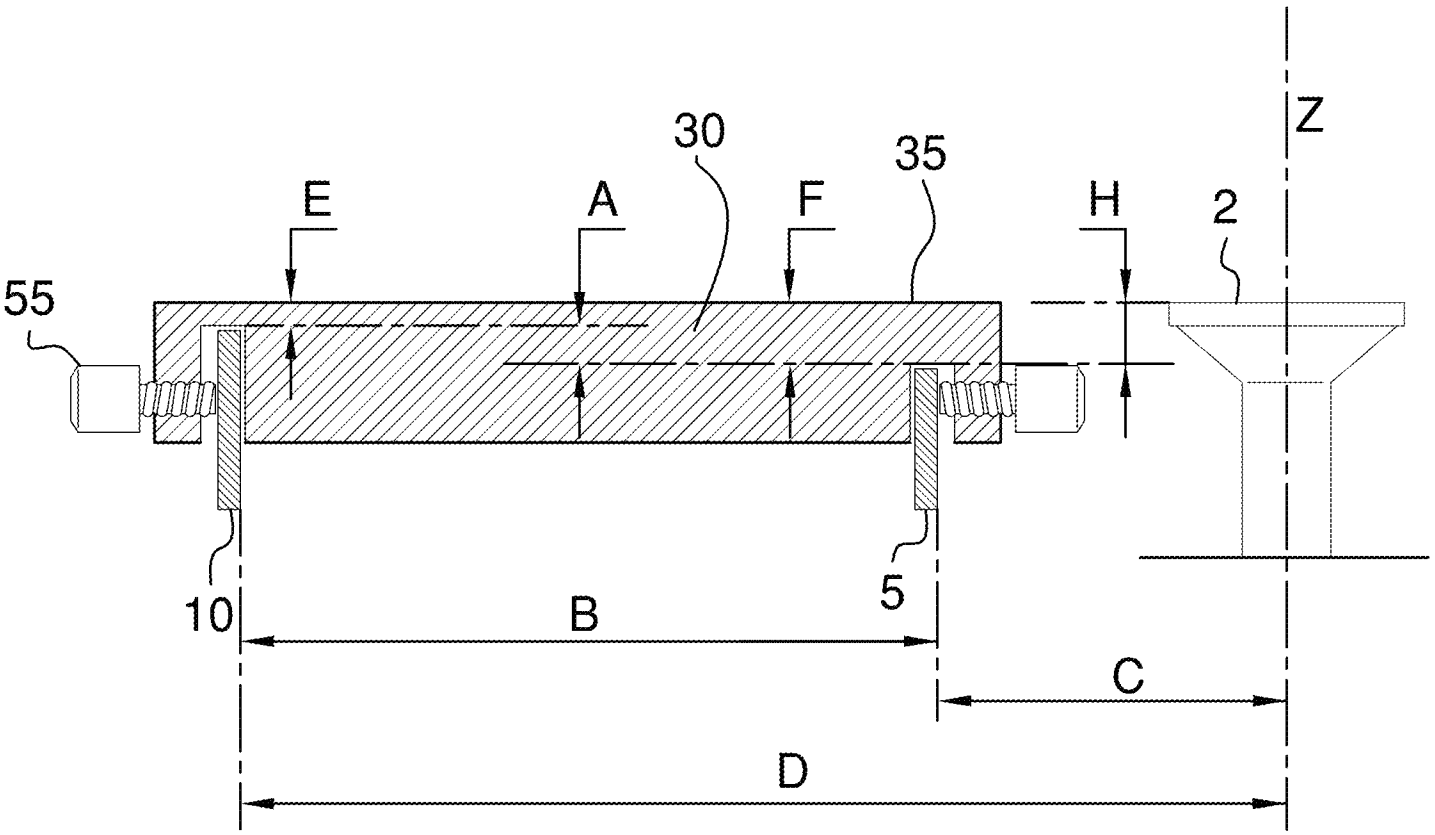
FIG. 3 is a cross-sectional view of the slope guide attached to the large screed ring and small screed ring.

The segments 11 of the second screed ring 10 are a plurality of rigid ring-shaped portions of a screed ring 10 that can be used in segments or interconnected together to form a complete screed ring. Different sized desired diameter screed rings can be formed and used in the installation of a shower floor mud surface. The segments of the screed ring can either be attachable to each other or not attachable to each other. The device could be used with the screed rings only; screed rings, slope guide(s); the screed ring, segments of the screed rings; the screed ring, segments of the screed rings, slope guide(s);

The slope guide 30 is a rigid structurally sound element which holds together temporarily or permanently the first screed ring 5 and the second screed ring 10 and maintains the desired location and orientation of those screed rings in relation to each other. The purpose of the slope guide 30 is to ensure that the slope of the floor mud 75 is in line with building codes and standards. The slope guide 30 holds the screed elements in a desired location and orientation in three-dimensional space after the device is installed. On the bottom surface of the slope guide 30 are two ring grooves: a first ring groove 40 and a second ring groove 45 into which the first screed ring 5 and second screed ring 10 are respectively placed. The bottom surface of the first ring groove 41 is placed against the screed edge 20 of the first screed ring 5. The bottom surface of the second ring groove 46 is placed against the screed edge 20 of the second screed ring 10 or segment 11 of the second screed ring. The depth of the respective first ring groove 40 is different from the second ring groove 45 so that the screed rings can be properly positioned when implanted into shower floor mud 75. The depth of the first ring groove 40 has less depth than the second ring groove 45 to ensure the proper slope is achieved when the tool is installed such as depicted in FIG. 3. The difference between depths of two ring grooves is A. the difference between radius of first screed ring 5 (C) and radius of the second screed ring 10 (D) is B. The desired correlation between A and B ensures correct slope of the shower floor mud surface. The distance between the first ring groove 40 and second ring groove 45 is ensures desired distance B, between the first screed ring 5 and second screed ring 10 when they each are installed into the slope guide 30.

Dimension F, which is shown in FIG. 3, is the desired distance between the plane of the horizontal top surface 35 of the slope guide 30 and the plane of the bottom 50 of the first ring groove 40. Dimension E is the desired distance between the bottom surface of the second ring groove 46 and of the horizontal top surface 35 of the slope guide 30. The bottom of the first ring groove 41 and the bottom of the second ring groove 46 are both parallel to the horizontal top surface 35 of the slope guide 30. When the device is installed properly, with the top surface 35 of the slope guide 30 horizontal, dimension F and E ensures desired location and orientation of both screed elements of the device in 3D space.

When the invention is installed properly, the desired dimension H, which is shown in FIG. 3, shows the correct position of the invention in relation to the top surface of the shower drain 2. Dimension H gives space for the thickness of ceramic tile and the thickness of a setting material, commonly known as "thin-set", which is installed on top of the floor mud later. Dimension H ensures that top surface of ceramic tile will be flat/even with the top surface of the shower drain, after ceramic tile installed. The top surface of the shower drain is referred to as a datum, which determines the position of both screed rings in vertical direction.

Figure 5:
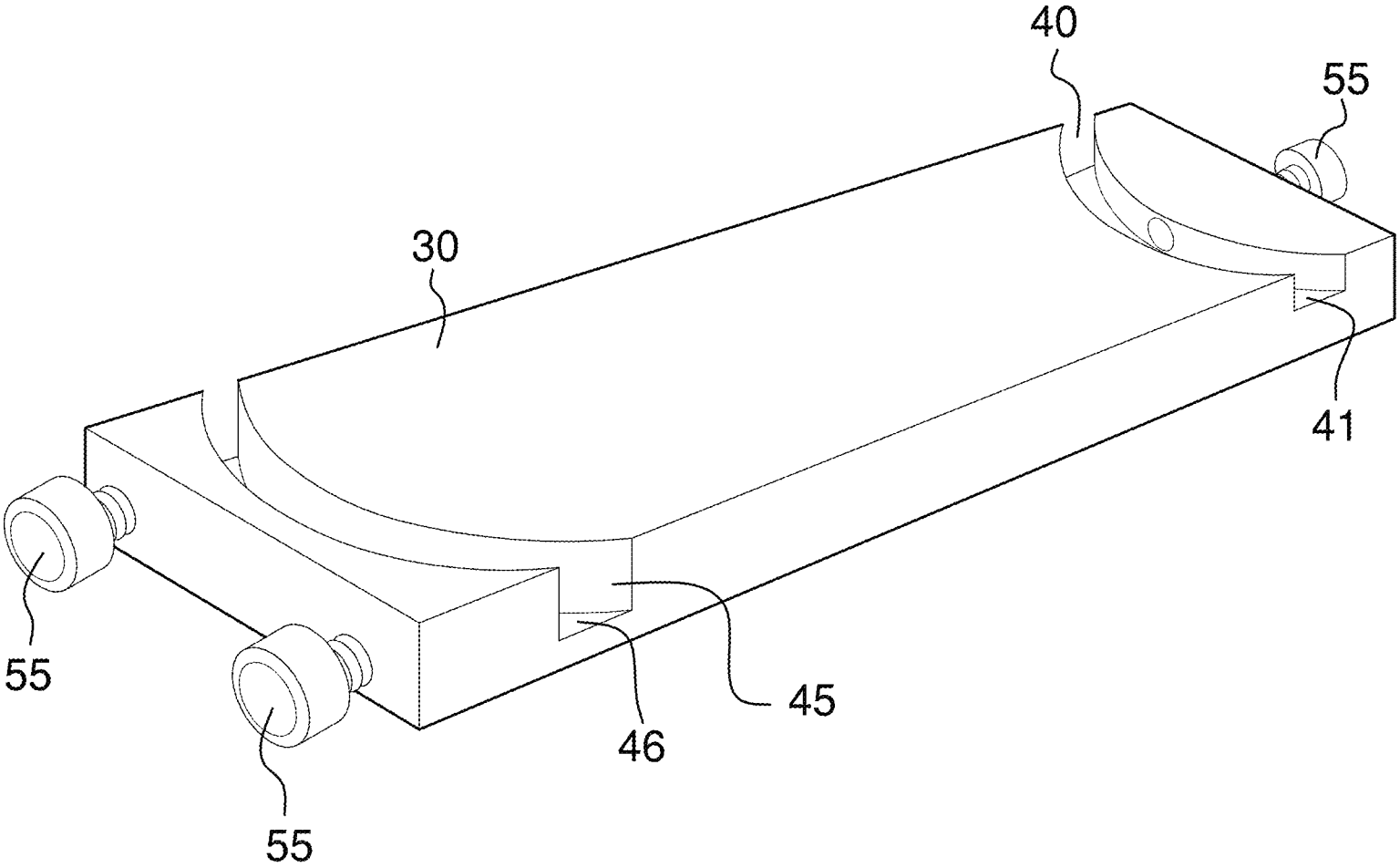
FIG. 5 is a bottom isometric view of the first embodiment.

The plurality of holding screws 55, which is shown in FIG. 5, is used to ensure that the screed rings do not move during the installation of the device.

Figure 7:
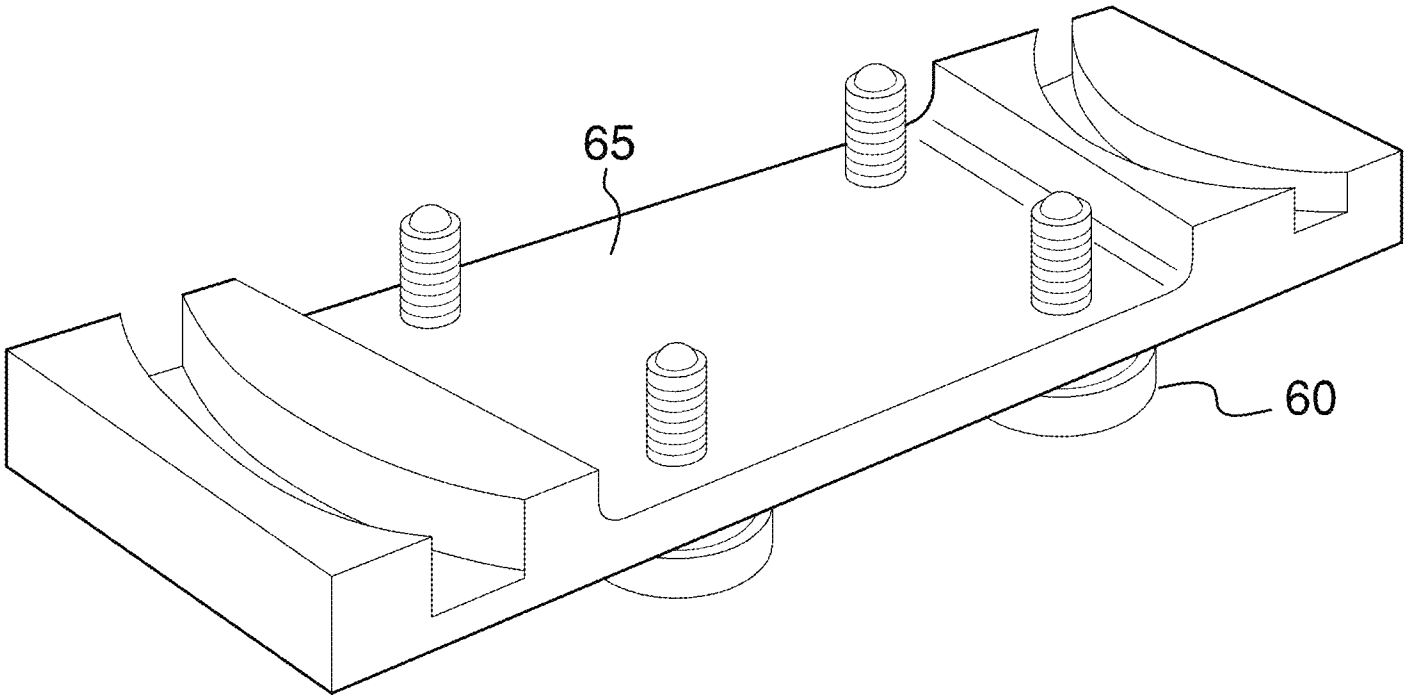
FIG. 7 shows a second embodiment of the device with a plurality of level adjusters and a level adjuster contact surfaces.
Figure 8:
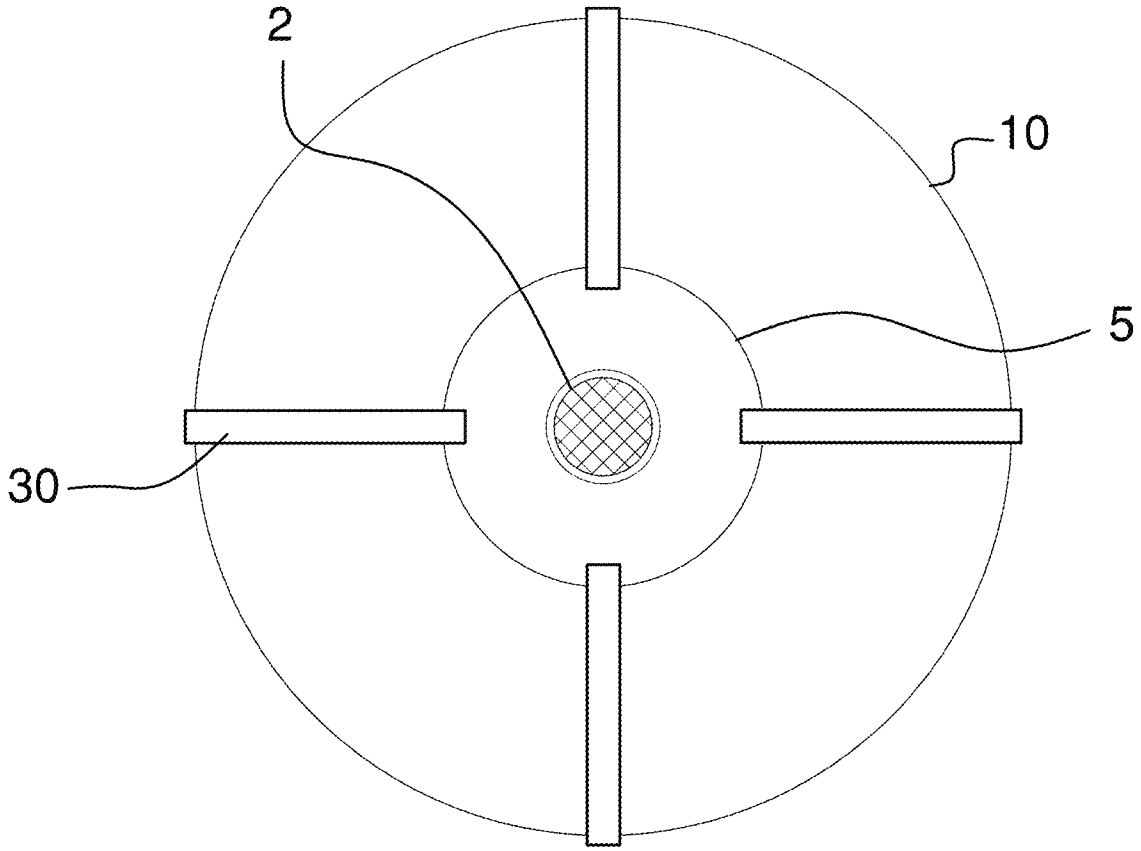
FIG. 8 shows a third embodiment where the screed rings are permanently attached to the slope guides.

In an alternative embodiment, the slope guide may be modified such as depicted in FIG. 7 to incorporate a plurality of leveling adjusters 60 and a milled-out portion 65 of the bottom surface of the slope guide 30. The plurality of leveling adjusters 60 permit the craftsman to appropriately level the slope guide to ensure a proper orientation of the slope guide 30. When the plurality of level adjusters 60 is utilized, the device stands on the floor. When the plurality of level adjusters 60 are absent the device stands on the floor mud 75. The milled-out portion of the bottom surface of slope guide 30 reduces pressure of the floor mud onto the bottom of the slope guide 30 at a time of installation on top of the floor mud. The slope guide 30 also provides a flat top surface, which can support a level measuring tool in order to verify horizontal orientation of the top surface of the slope guide 30 relative to the shower drain 2.

The slope guide 30 may also incorporate a handle 70 on the slope guide's 30 top surface in order to use alternative level measuring tools, to determine horizontal orientation of the top surface of the slope guide 30. When handle 70 is vertical, the top surface of the slope guide 30 is horizontal.

It is also anticipated that the slope guide can be used as a screed tool 80. For example, the horizontal surface 35 may be used to remove excess mud 75 from above the screed edges 20 of the screed elements.

This device is usable with at least two ring-shaped screed elements with different desired geometric radiuses and temporarily or permanently embedded to the shower floor mud with desired location and orientation.

The geometric centers of all ring-shaped elements are located on the same vertical axis "Z", which passes through the center of a shower drain 2; each screed element is located on its own horizontal plane with a desired distance between them in vertical direction and with the desired difference between geometric radiuses of two elements.

Figure 9:
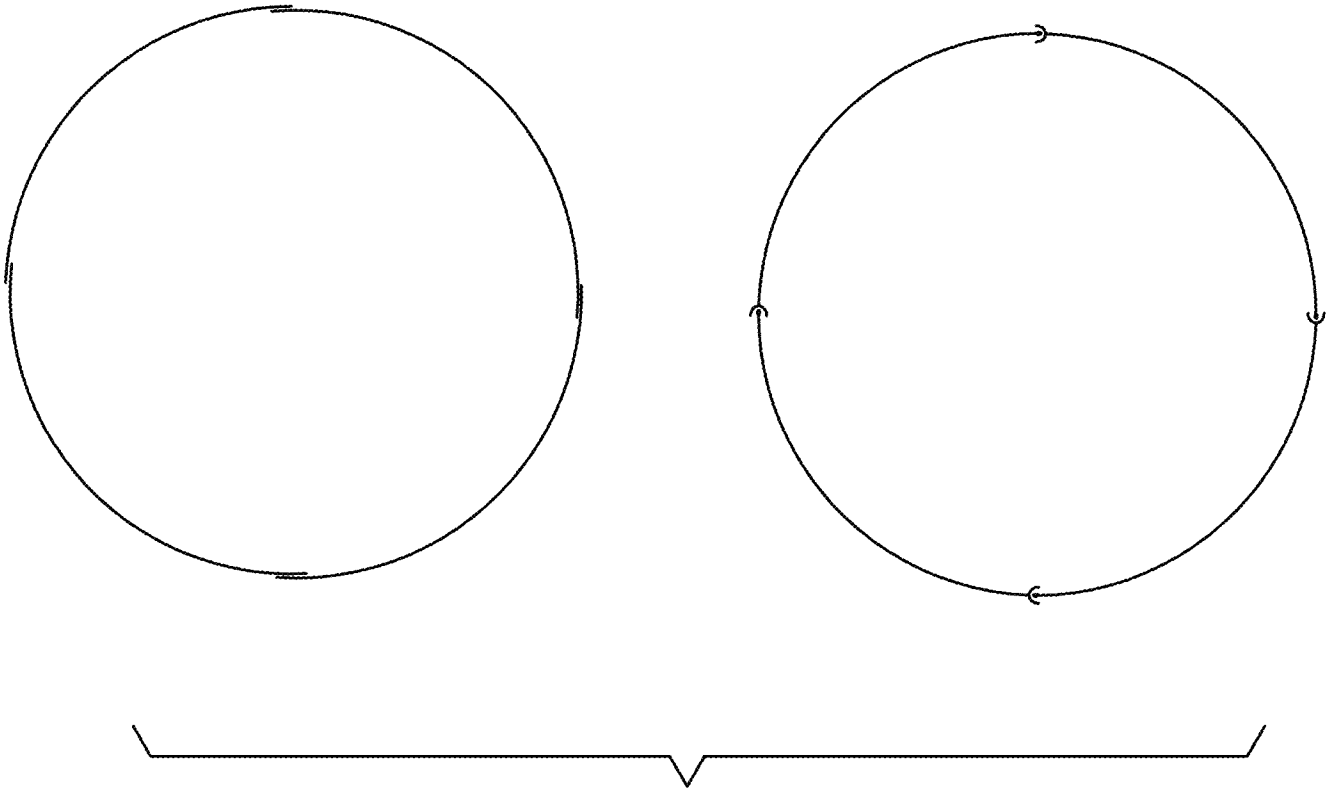
FIG. 9 shows two embodiments on how large screed ring segments may attach to each other. The embodiment on the left shows the ends of the screed ring segments to overlap each other. The embodiment on the right in the figure shows the screed ring segments connect with each other.
Figure 10:
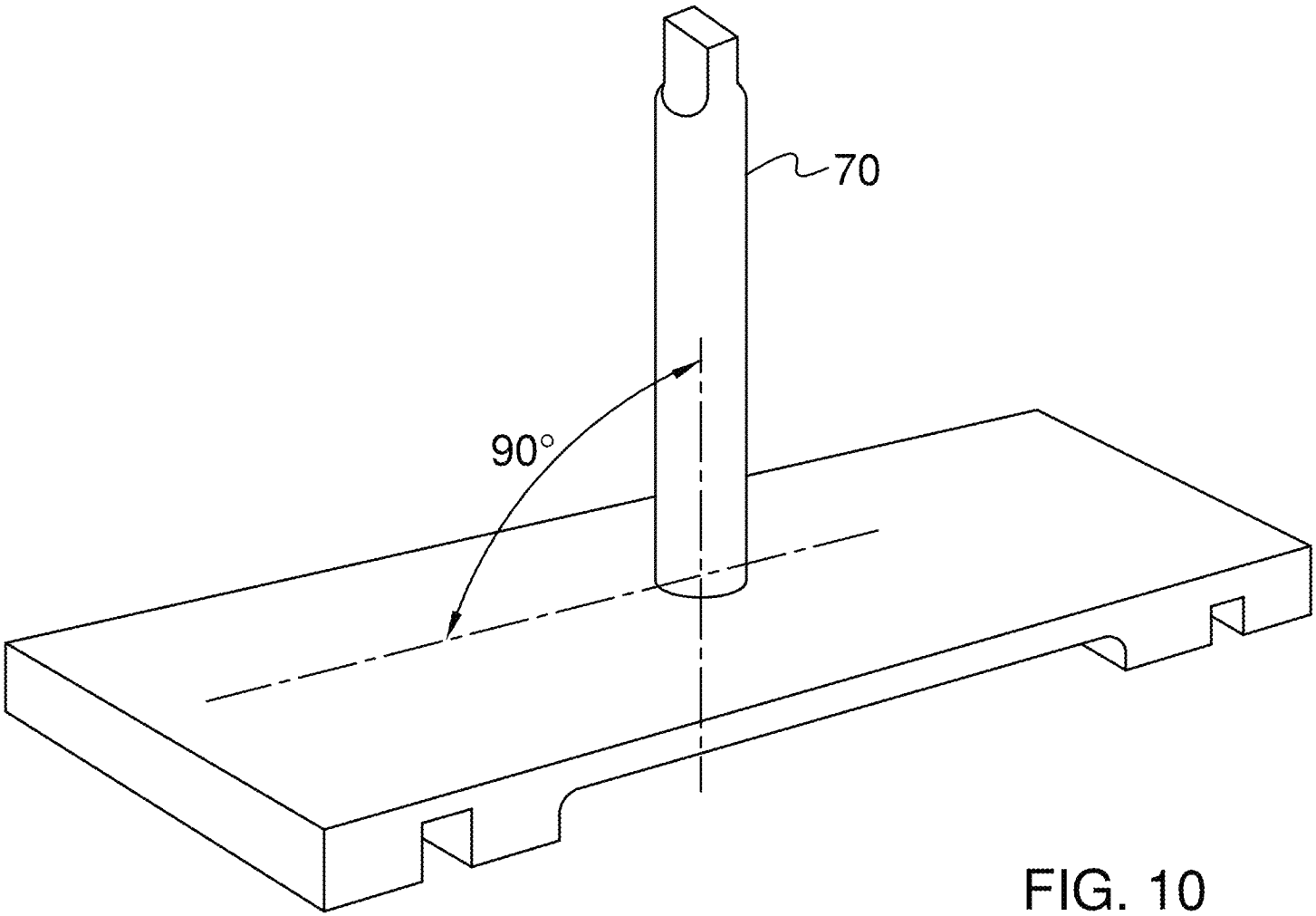
FIG. 10 shows a handle attached to the slope guide.

The screed rings are embedded into the shower floor mud for the purpose to create support for the screed tool which creates the desired surface of the shower floor mud with the desired slope to a shower drain such as depicted in FIG. 4. The device can be used with or without a slope guide 30. The slope guide 30 can be used with screed rings or with segments of the screed rings; the segments of the screed rings can be interconnected to form a complete circular screed ring, which is shown in FIG. 9. The segments of the second screed ring or the complete big screed ring can be used with a slope guide 30 to achieve the desired slope to the shower surface.

When a tradesman is installing the shower floor he will pour a predetermined amount of shower floor mud on the shower floor area. After the shower floor mud has been poured, the first screed ring 5 and second screed ring 10 are placed on top of shower floor mud 75 and around the shower drain 2 in a desired location and orientation. There are four presented methods that the device may be used. All four methods create desired uniform slope to a drain with desired smooth surface of the shower floor mud.

In the first method, only two screed rings of the device are used: a first screed ring and a second ring. This method is used when entire area of the shower floor could be done at the same time. The first method is to place mud on the shower floor and then position the screed rings, where the first screed ring is at the center of the second screed ring and the drain 2 of the shower is at the center of the first screed ring. The screed edge of the second screed ring is higher than the screed edge of the first screed ring. The screed edge of the first screed ring is below the top of the shower drain at the desired distance. Top edge of the big ring and small ring are in two different horizontal planes, with desired distance between those planes. After both rings are correctly installed and firmly implanted into floor mud, user/operator drops more mud on top of the rings. Then mud should be pressed down/"packed" by a flat trowel before excess of the floor mud, which is above the rings, removed/"shaved off" with a screed tool. Desired distance between top edges of big ring and small ring in radial direction determines sloped surface of the floor mud. When both rings are disposable, they can be left inside a floor mud. Reusable rings should be removed and the empty gaps left from the removable of the rings are filled with mud and the surface of the floor mud fixed with a flat trowel. Once the shower floor mud is "ironed out" with a flat trowel, the shower floor mud job is considered to be finished.

In the second method, three elements of the device are used: first screed ring, the segment of the second screed ring, and the slope guide. This method should be used when, a mud job should be performed section by section, or when the shower drain 2 is close to the wall. After all elements are assembled together and the floor mud is placed on the shower floor, the device is placed on top of the floor mud with the shower drain located at the center of the first screed ring. Then the slope guide 30, with all elements attached, is pressed into the floor mud until top surface of the slope guide 30 is horizontal and top edge of the first screed ring is located below the top of the drain at the desired distance.

The slope guide 30, thereby automatically generates the desired distance between the screed edges of the first screed ring and the segment of the second screed ring in vertical and horizontal radial direction. Also, when the top surface of the slope guide is horizontal, slope guide ensures horizontal position of both elements of the device. After the assembled device and elements are correctly installed and the elements are firmly implanted into the floor mud, the slope guide 30 is then unattached and removed.

Then the user/operator drops more mud on top of the "working" area/section of the shower floor. Then mud should be pressed down/"packed" by a flat trowel before excess of the floor mud removed/"shaved off" with a screed tool. Small ring and segment of the big ring are temporarily left inside the mud in a first section of a shower floor area. Then the other segment of the big ring can be installed on top of mud in second section, for instance in opposite direction of the shower floor area. Second segment of the big ring attached to the slope guide. Then the device can be placed on the opposite side of the shower floor. The top edge of the first screed ring 5, which is already implanted into floor mud, should fit into related ring's groove 40 of the slope guide 30. After device is located correctly, the slope guide is pressed into the floor mud until the screed edge 20 of a first screed ring touches the bottom of the related ring's groove and until the top surface 35 of the slope guide 30 is horizontal. The slope guide 30 automatically generates desired location and orientation of two elements of the device. After the assembled device is correctly installed and the elements are firmly implanted into the floor mud, the slope guide 30 is then unattached and removed. After the second segment of the big ring firmly implanted into floor mud, user/operator drops more mud on top of the "working" area (second section of a shower floor area). Then mud should be pressed down/"packed" by a flat trowel before excess of the floor mud removed/"shaved off" with a screed tool. Then, two more segments of the big ring can be installed. When two segments of the big ring implanted in two opposite sections of a shower floor with the help of a slope guide, other two section of the big ring can be installed without slope guide. Those two can be implanted into mud with "bare hands" and with the same floor mud operational procedure.

After all four areas of the shower floor are done, the disposable elements can be left inside a floor mud. The reusable elements should be removed, the empty gaps filled with mud, and the surface of the floor mud fixed or "ironed" by a flat trowel. The shower floor mud job is then considered finished. The user may utilize a plurality of level adjusters 60, when he uses a slope guide 30. Also, the user can use a pole, in order to use alternative way to verify level of the top surface of the slope guide, when he installs device.

With the third method, three elements of the device are used: small ring, big ring, slope guide. This method used when entire era of the shower floor could be done at the same time. This method is similar to the first method, which didn't use the slope guide. This method is using a slope guide in order to make this method more effective comparatively to the first one. Slope guide automatically establishes correct location and orientation of small ring and big ring, and therefore simplifies, speeds up process and increases level of precision. After all elements assembled together and floor mud placed on the floor, device placed on top of the floor mud as shower drain located at the center of a small ring. Then slope guide, with all elements attached, pressed into the floor mud until top surface of the slope guide is horizontal and top edge of a small ring located below the top of the drain in desired distance. Slope guide automatically generates desired distance between top edges of the small ring and the big ring in vertical and in horizontal radial direction. After assembled device and elements correctly installed and elements firmly implanted into floor mud, slope guide then unattached and removed. Then user/operator drops more mud on top of the "working" area. Then mud should be pressed down/"packed" by a flat trowel before excess of the floor mud removed/"shaved off" with a screed tool. Disposable elements can be left inside a floor mud. Reusable elements removed, empty gaps filled with mud, surface of the floor mud fixed, "ironed" by a flat trowel. Shower floor mud job considered finished. The user may utilize level adjusters, when he use slope guide. Also, user can use a pole, in order to use alternative way to verify level of the top surface of the slope guide, when he installs device.

With the fourth method, more than three elements of the device are used: small ring, big ring, and more than one slope guide. This method is similar to the third method with the difference that device has more than one slope guide. This method primarily used with completely disposable elements, which can be left implanted into floor mud. Small ring and big ring are disposable. Slope guides made cheap and can be disposable and in some instances can be reusable.

After all elements assembled together and floor mud placed on the floor, device placed on top of the floor mud as shower drain located at the center of a small ring. Then entire structure of the device, with all elements attached, pressed into the floor mud until top surfaces of all slope guides are horizontal and top edge of a small ring located below the top of the drain in desired distance. Slope guides automatically generates desired distance between top edges of the small ring and the big ring in vertical and in horizontal radial direction. After assembled device and elements correctly installed and elements firmly implanted into floor mud, slope guides then unattached and removed if those are reusable. Then user/operator drops more mud on top of the "working" area of the shower floor. Then mud should be pressed down/"packed" by a flat trowel before excess of the floor mud removed/"shaved off" with a screed tool. After excess of the floor mud shaved off, surface of the floor mud "ironed" with a flat trowel. Shower floor mud job considered finished. The user may utilize level adjusters, when it present.

This device may be further comprised of a screed 80. A screed is the term used to describe a rigid object with a straight edge that is drawn over freshly poured concrete/mud on top of specially designed rigid and stable support. Device described herein is a rigid buildup support for the screed and described in three separate embodiments. Shape of this support determines shape of the shower floor mud surface. The support is comprised of a plurality of screed elements. A screed element may be a screed ring or a segment of a screed ring. A screed edge is a top edge of each of the screed elements of the device that are in contact with a screed while in use. When the screed is moved on the screed edge of the screed elements, it forms the desired slope and shape of the floor mud surface by removing excess of the mud, which is above those elements of the device. Mud which left below screed edges forms the desired or required shape.

The inventor claims:

1. A shower mud forming device, which is comprised of:

a. a first screed ring;

wherein the first screed ring has a screed edge and a bottom surface;

b. a second screed ring;

wherein the second screed ring has a screed edge and a bottom surface;

c. a slope guide;
wherein the slope guide has a top surface and a bottom surface;
wherein the slope guide has a first end and a second end;
wherein the slope guide has a first screed ring groove;
wherein the first screed ring groove is provided on the bottom surface of the slope guide;
wherein the slope guide provides a second screed ring groove;
wherein the second screed ring groove is provided on the bottom surface of the slope guide;
wherein the slope guide provides a plurality of holding screws.

2. The shower mud forming device as described in claim 1 wherein the first screed ring is further comprised of a plurality of screed ring segments.

3. The shower mud forming device as described in claim 1 wherein the second screed ring is further comprised of a plurality of screed ring segments.

4. The shower mud forming device as described in claim 2 wherein the plurality of first screed ring segments connect together to form a shape.

5. The shower mud forming device as described in claim 3 wherein the plurality of second screed ring segments connect together to form a shape.

6. The shower mud forming device as described in claim 1 wherein the first screed ring and second screed ring have a rigid structure.

7. The shower mud forming device as described in claim 1 wherein the first screed ring has a smaller diameter than the second screed ring.

8. The shower mud forming device as described in claim 1 wherein the first screed ring is concentrically placed within the second screed ring.

9. The shower mud forming device as described in claim 1 wherein a handle is provided on the top surface of the slope guide.

10. The shower mud forming device as described in claim 1 wherein the first screed ring is on a separate horizontal plane from the second screed ring.

11. The shower mud forming device as described in claim 1 wherein a screed is provided.

12. The shower mud forming device as described in claim 8 wherein the screed edge of the first screed ring has a lower altitude relative to the screed edge of second screed ring.

13. The shower mud forming device as described in claim 1 wherein the slope guide provides a plurality of leveling adjusters.

14. A shower mud forming device, which is comprised of:
a. a first screed ring;
wherein the first screed ring has a screed edge and a bottom surface;
b. a second screed ring segment;
wherein the second screed ring segment has a screed edge and a bottom surface;
c. a slope guide;
wherein the slope guide has a top surface and a bottom surface;
wherein the slope guide has a first end and a second end;
wherein the slope guide has a first screed ring groove;
wherein the first screed ring groove is provided on the bottom surface of the slope guide;
wherein the slope guide provides a second screed ring groove;
wherein the second screed ring groove is provided on the bottom surface of the slope guide;
wherein the slope guide provides a plurality of holding screws.

15. The shower mud forming device as described in claim 14 wherein the first screed ring is further comprised of a plurality of first screed ring segments.

16. The shower mud forming device as described in claim 14 wherein a plurality of second screed ring segments are provided.

17. The shower mud forming device as described in claim 15 wherein the plurality of first screed ring segments connect together to form a shape.

18. The shower mud forming device as described in claim 16 wherein the plurality of second screed ring segments connect together to form a shape.

19. The shower mud forming device as described in claim 14 wherein the first screed ring and second screed ring segment have a rigid structure.

20. The shower mud forming device as described in claim 14 wherein a handle is provided on the top surface of the slope guide.

21. The shower mud forming device as described in claim 14 wherein the first screed ring is on a separate horizontal plane from the second screed ring segment.

22. The shower mud forming device as described in claim 14 wherein a screed is provided.

23. The shower mud forming device as described in claim 21 wherein the screed edge of the first screed ring has a lower altitude relative to the screed edge of second screed ring segment.

24. The shower mud forming device as described in claim 14 wherein the slope guide provides a plurality of leveling adjusters.

25. A shower mud forming device, which is comprised of:
a. a first screed ring;
wherein the first screed ring has a screed edge and a bottom surface;
b. a second screed ring;
wherein the second screed ring has a screed edge and a bottom surface;
c. a plurality of slope guides;
wherein the plurality of slope guides have a top surface and a bottom surface;
wherein the plurality of slope guides each have a first end and a second end;
wherein each slope guide within the plurality of slope guides has a first screed ring groove;
wherein the first screed ring groove is provided on the bottom surface of each slope guide within the plurality of slope guides;
wherein each slope guide within the plurality of slope guides provides a second screed ring groove;
wherein the second screed ring groove is provided on the bottom surface of each slope guide within the plurality of slope guides;
wherein each slope guide within the plurality of slope guides provides a plurality of holding screws.

26. The shower mud forming device as described in claim 25 wherein the first screed ring is further comprised of a plurality of screed ring segments.

27. The shower mud forming device as described in claim 25 wherein the second screed ring is further comprised of a plurality of screed ring segments.

28. The shower mud forming device as described in claim 26 wherein the plurality of first screed ring segments connect together to form a shape.

29. The shower mud forming device as described in claim 27 wherein the plurality of second screed ring segments connect together to form a shape.

30. The shower mud forming device as described in claim 25 wherein the first screed ring and second screed ring have a rigid structure.

31. The shower mud forming device as described in claim 25 wherein the first screed ring has a smaller diameter than the second screed ring.

32. The shower mud forming device as described in claim 25 wherein the first screed ring is concentrically placed within the second screed ring.

33. The shower mud forming device as described in claim 25 wherein a handle is provided on the top surface of each of the slope guides.

34. The shower mud forming device as described in claim 25 wherein the first screed ring is on a separate horizontal plane from the second screed ring.

35. The shower mud forming device as described in claim 25 wherein a screed is provided.

36. The shower mud forming device as described in claim 34 wherein the screed edge of the first screed ring has a lower altitude relative to the screed edge of second screed ring.

37. The shower mud forming device as described in claim 1 wherein the slope guide provides a plurality of leveling adjusters.

38. A method to use the shower mud forming device as described in claim 1, which is comprised of the following steps:

a. placing mud on shower floor;
b. positioning the first screed ring in the mud wherein the screed edge of the first screed ring is below the top surface of the drain;
c. positioning the second screed ring in the mud wherein the screed edge of the second screed ring is higher than the screed edge of first screed ring;
d. removing excess mud above the screed edge of the first screed ring and above the screed edge of the second screed ring with a screed tool.

39. A method to use the shower mud forming device as described in claim 1, which is comprised of:

a. placing mud on shower floor;
b. attaching the slope guide to the first screed ring and second screed ring;
c. positioning the first screed ring in the mud wherein the screed edge of the first screed ring is below the top surface of the drain;
d. positioning the second screed ring in the mud wherein the screed edge of the second screed ring is higher than the screed edge of first screed ring;
e. pressing the slope guide with the first screed ring and second screed ring into the mud until the top surface of the slope guide is level with the top surface of the shower drain;
f. removing slope guide from the first screed ring and the second screed ring;
g. removing excess mud above the screed edge of the first screed ring and above the screed edge of the second screed ring with a screed tool.

40. A method to use the shower mud forming device as described in claim 14, which is comprised of:

a. placing mud on shower floor;
b. attaching the slope guide to the first screed ring and the second screed ring segment;
c. positioning the first screed ring in the mud wherein the screed edge of the first screed ring is below the top surface of the drain;
d. positioning the second screed ring segment in the mud wherein the screed edge of the second screed ring segment is higher than the screed edge of first screed ring;
e. pressing the slope guide with the first screed ring and second screed ring segment into the mud until the top surface of the slope guide is level with the top surface of the shower drain;
f. removing slope guide from the first screed ring and the second screed ring segment ;
g. removing excess mud above the screed edge of the first screed ring and above the screed edge of the second screed ring segment with a screed tool.

* * * * *